United States Patent [19]

Travaglini

[11] 4,140,070

[45] Feb. 20, 1979

[54] CONTROL FOR A DIFFERENTIAL FEED REGULATING DEVICE IN SEWING MACHINES

[75] Inventor: Giovanni Travaglini, Milan, Italy

[73] Assignee: Rockwell-Rimoldi, S.p.A., Milan, Italy

[21] Appl. No.: 837,132

[22] Filed: Sep. 28, 1977

[30] Foreign Application Priority Data

Oct. 13, 1976 [IT] Italy ..... 28264 A/76

[51] Int. Cl.[2] ..... D05B 27/08

[52] U.S. Cl. ..... 112/209

[58] Field of Search ..... 112/209, 210, 47, 203, 112/208, 215

[56] References Cited

U.S. PATENT DOCUMENTS

| | | | |
|---|---|---|---|
| 2,009,747 | 7/1935 | Sauer | 112/209 |
| 2,669,205 | 2/1954 | Hayes | 112/209 |
| 3,357,384 | 12/1967 | Washburn | 112/209 |
| 3,368,507 | 2/1968 | Orth | 112/209 |
| 3,382,827 | 5/1968 | Von Hagen | 112/209 |
| 3,467,040 | 9/1969 | Hacklander | 112/210 |
| 3,611,817 | 10/1971 | Smith et al. | 112/209 |
| 3,834,334 | 9/1974 | Adams et al. | 112/210 |
| 4,027,609 | 6/1977 | Kerr | 112/209 |
| 4,067,274 | 1/1978 | Marforio | 112/209 |

*Primary Examiner*—Werner H. Schroeder
*Assistant Examiner*—Moshe I. Cohen

[57] ABSTRACT

An adjusting apparatus contained within the base of a sewing machine for selectively setting the desired limits of travel of the differential feed dog relative to that of the main feed dog and a manual actuating device operatively associated with the adjusting apparatus for causing the differential feed dog to travel within the limits governed by the adjusting apparatus when desired.

3 Claims, 4 Drawing Figures

9
13
22
21
12
8
23
60
7
20
6
11
15
10
5
1
4
2
3
17
19
16'
18
14
16
56
24
59

CONTROL FOR A DIFFERENTIAL FEED REGULATING DEVICE IN SEWING MACHINES

BACKGROUND OF THE INVENTION

The present invention pertains to a device for regulating the differential feed in sewing machines and more particularly to a device for regulating the travel of the differential feed dog relative to the travel of the main, or stitch feed dog, and for varying its travel during operation. With known forms of such devices, the controls for regulating the travel of the differential dog are mounted on the exterior surface of the frame of the machine and are provided with screw limiting members which serve as a means for pre-setting and fixing the desired range of regulation for the travel of the differential feed dog.

With the controls for known devices being located on the exterior surface of the frame of the machine, does not permit said controls to be disposed in an easily accessible position for the operator.

Additionally, with the above-mentioned limiting devices being of the screw type, the setting or fixing of the range of variation for the travel of the differential dog necessitates what is considered an excessive amount of non-productive time for making such settings. The problem regarding the location of the above-mentioned controls is particularly serious in those sewing machines whose frame has a specially shaped base, such for example as the so-called feed-off-the-arm type, or the free or cylindrical base machines, for the material is usually wrapped about the base during sewing and any external control in the base would prevent easy handling of said material.

The aim of the present invention is to provide a means for the regulation of the differential feed device by means of an easily operable and readily accessible control that is located solely within the sewing machine's base in a manner whereby the exterior surface configuration of said base is unchanged thereby.

SUMMARY OF THE INVENTION

The control for a differential feed regulating device for sewing machines according to the present invention is provided with a means within the machine's base for supporting an oscillatable feed shaft having a sector on which a slider is movably mounted and operatively connected to the support for the differential feed dog. This slider can be selectively positioned along the sector by means of the regulating device which includes a connecting arm that is keyed to a shaft having a lever that can be manipulated manually by the operator. A distinctive feature of the invention is that the control is mounted entirely within the base and that it includes an operating device having a gear that is operatively connected to the lever and is carried on said operating device. This gear is caused to rotate by means of the operating device so as to impart to the lever an initial angular movement that fixes the desired range of regulation for the travel of the differential feed dog relative to that of the main feed dog. The device is caused to move by means of the level so as to vary the ratio of the rates of travel within the limits of the range that way initially fixed for a machine in operation.

An important advantage of the invention is that of providing a control as described above which will not effect or require a change in the external structure of the base of the sewing machine in that area through which the material to be sewn travels.

Another advantage is that of providing an operating device with a gear member that is operatively connected to a lever of the regulating device which permits an operator to quickly and easily obtain the desired regulation limits and to vary the differential ratio between the limits in a machine during operation. Other features and advantages of the present invention will become more fully apparent by reference to the appended claims and as the following detailed description proceeds in reference to the figures of drawing wherein:

DESCRIPTION OF THE PREFERRED EMBODIMENT

Figures 1, 4:
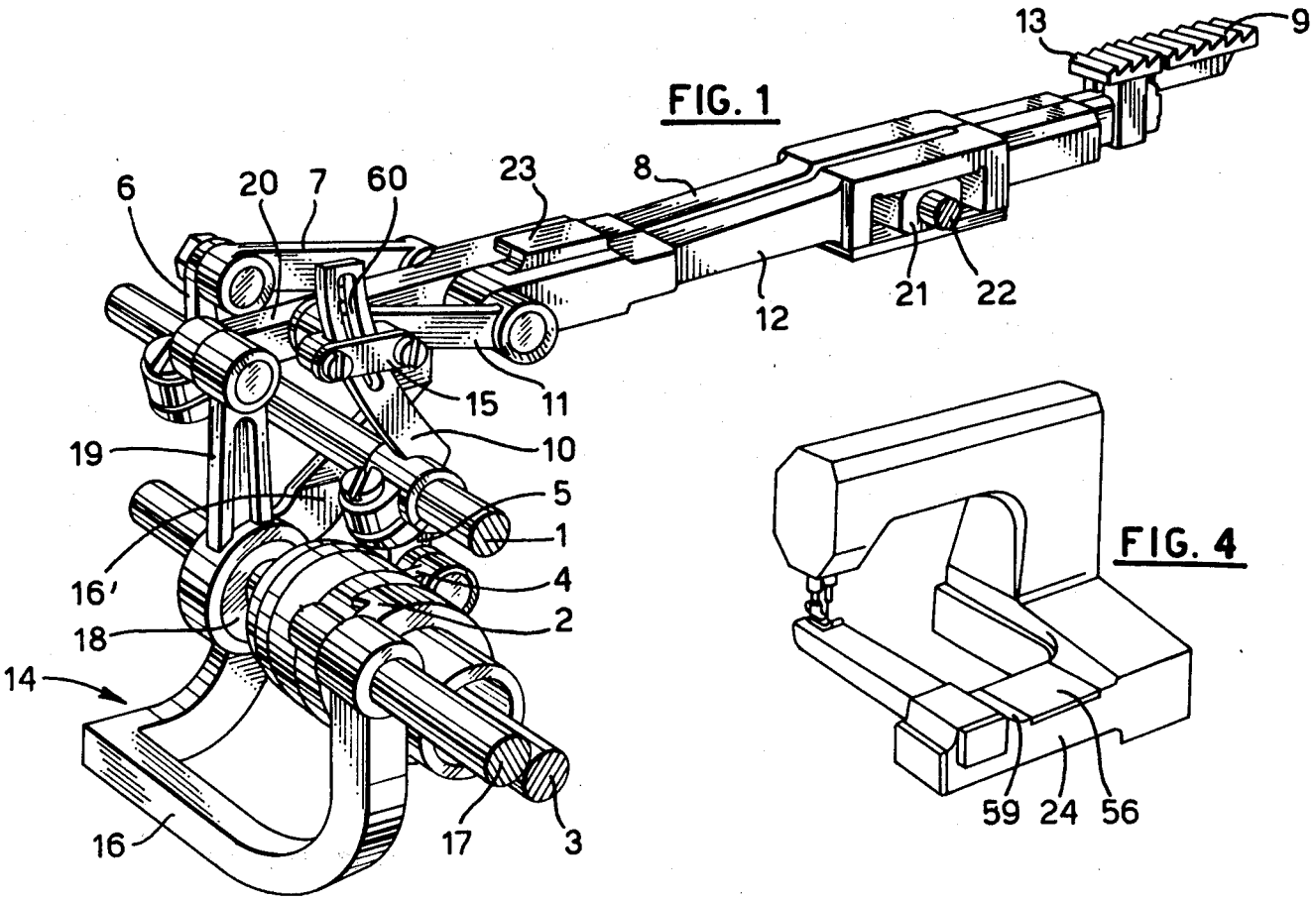
FIG. 1 is a perspective view of a differential feed and the regulating device therefor.
FIG. 4 is a perspective view of one form of sewing machine base to which the control according to the invention is applicable.

Referring now to FIG. 1, a differential feed for a conventional sewing machine includes a feed shaft 1 that is caused to oscillate in a known manner by means of a stitch cam 2 which is fixed on a rotatably driven shaft 3.

This stitch cam controls movement of a connecting rod 4 that is connected to one end of an arm 5 whose opposite end is operatively associated with the oscillating feed shaft 1 which, in turn, controls pivotal movement of a first grooved sector 6.

This first sector 6 is connected by means of a link 7 to a support arm 8 that carries the main or stitch feed dog 9 on its free end.

The oscillating feed shaft 1 also controls pivotal movement of a second sector 10 that is connected by means of a link 11 to a support arm 12 which in similar manner to the above-mentioned support arm 8 supports the differential feed dog 13. The alternating pivotal movement transmitted by the two sectors 6 and 10 to their respective support arms 8 and 12 defines the feed path for the material to the feed dogs 9 and 13. The characteristics of the feed path depend on the location of the pivot points of the links 7 and 11 on their respective sectors 6 and 10. In order that the travel of the differential feed dog 13 may be varied with respect to that of the main feed dog 9, a regulating device 14 is provided, which serves as a means to selectively shift the pivot point of the link 11 along the second sector 10.

In order to obtain a smooth and rapid shifting of the above-mentioned point, the regulating device 14 is provided with a slider 15 that is movably mounted on the second sector 10 and is connected either with the link 11 or with a rod 16' that is hinged to a transmission arm 16. This transmission arm 16 is fixed on an auxiliary shaft 17 the angular position of which controls the position of the slider 15 on the second sector 10.

The feed device also includes an alternating lifting means for the feed dogs, which includes a cam 18 that is fixed on the rotating shaft 3 and in operative association with one end of a connecting rod 19. The opposite end of the connecting rod 19 is attached to an extension 20 provided on one end of the support arm 8 which carries the main feed dog 9.

The support arms 8 and 12 are slidably mounted on a block 21 which is pivotably supported by means of a pin 22 that is journaled in suitable opposed openings (not shown) provided in the frame of the machine.

The alternating lifting movement for the support arm 12 are transmitted from the support arm 8 by means of a pair of ear elements 23 (one only shown in FIG. 1) which form an integral part of the support arm 12 and extend from the latter in a manner so as to be engaged by said support arm 8.

Figure 2:
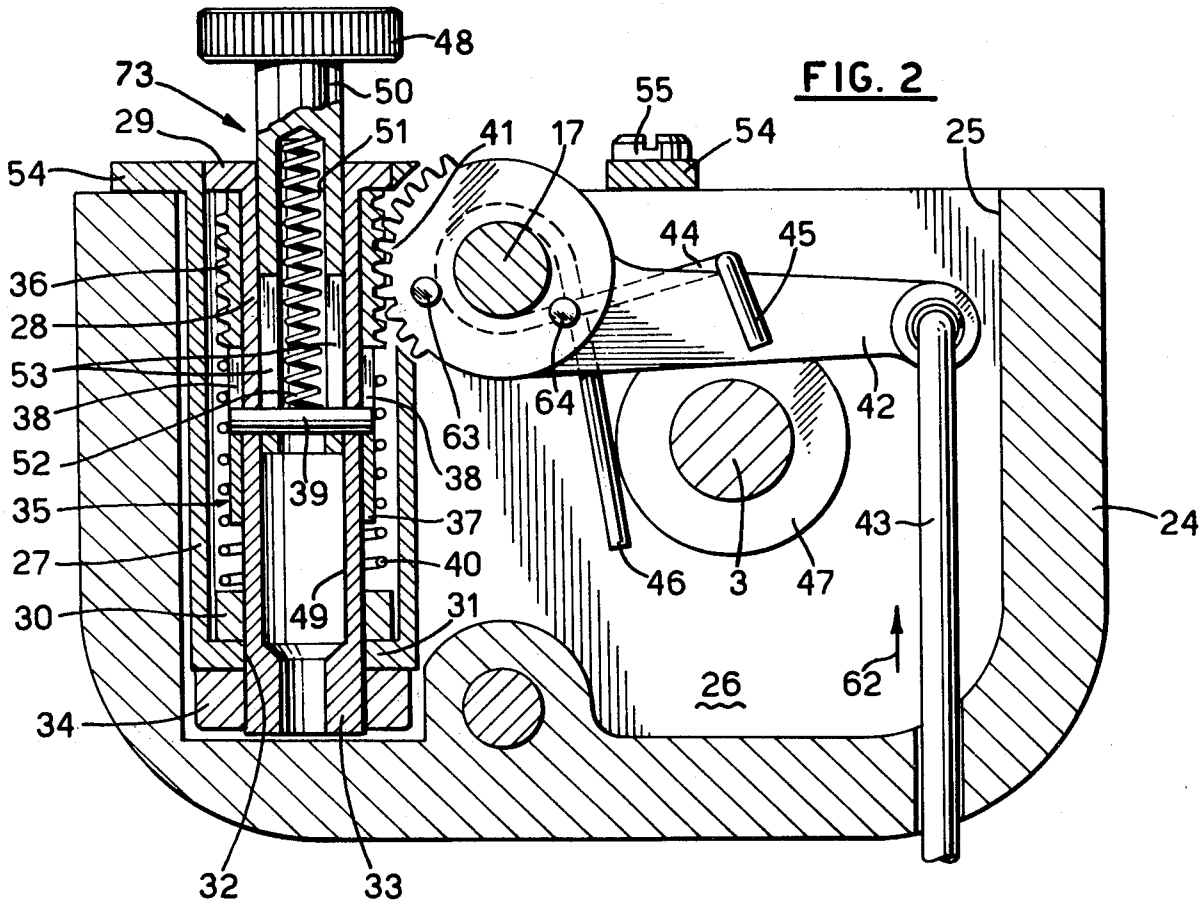
FIG. 2 is a sectional view of the control according to the invention for regulating the travel of the differential feed dogs.

With reference to FIG. 2, a control or adjusting means generally indicated by numeral 73 for the regulating device 14 is mounted entirely within a compartment 25 of the sewing machine's base 24. This compartment 25 is separated by a dividing wall 26 from the compartment within which the differential feed described above is located.

The above-mentioned control 73 includes a support bushing 27 within which an actuating device 28 that defines a flanged sleeve is rotatably supported.

Figure 3:
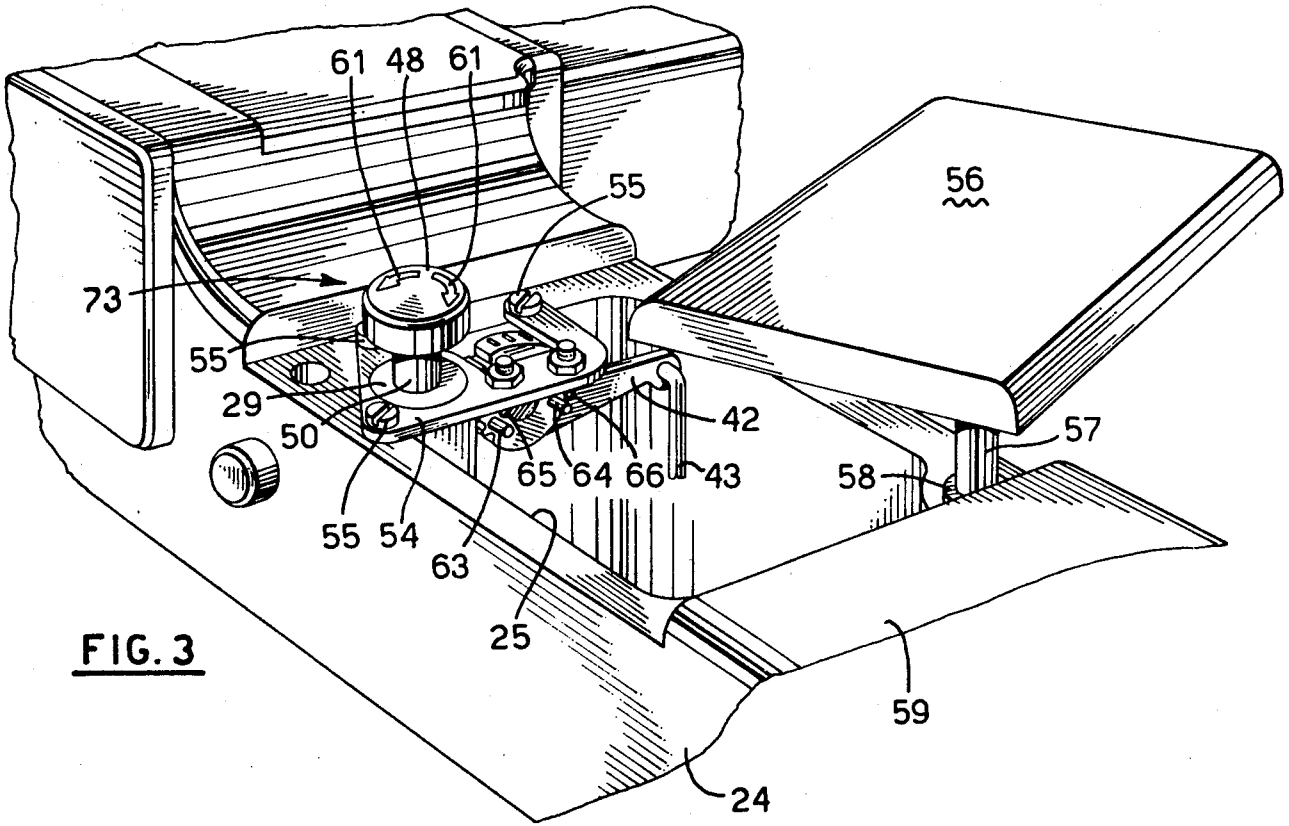
FIG. 3 is a perspective view of the control in FIG. 2 in a sewing machine.

The upper part of the actuating device 28, which is substantially cylindrical, is provided with an integrally formed flange 29 which as shown in FIGS. 2 and 3 is disposed within the upper end of the bushing 27. The lower part of the actuating device 28 is provided with a collar 30 that is located so as to be in engagement with the lower internal surface 31 of the bushing 27. The lower portion of the actuating device 28 protrudes through a central hole 32 formed in the lower surface of the bushing 27. This protruding portion is identified by numeral 33 and has a collar 34 assembled thereon which in cooperation with collar 30 serves to maintain the above-mentioned operating device 28 in position.

The outer cylindrical surface of the actuating device 28 has a gear member 35 assembled thereon which includes an endless screw 36 and a lower integrally formed sleeve portion 37 which is provided with two diametrically opposed slots 38 within which the ends of a transverse pin 39 carried by the actuating device 28 are disposed.

A helical spring 40 is assembled on the lower sleeve portion 37 intermediate the endless screw 36 and the collar 30 and serves to continually urge the gear 35 into engagement with the underside of the flange 29.

The endless screw 36 meshes with a toothed sector 41 located on a lever 42 that is fixed on that part of the auxiliary shaft 17 that projects into the compartment 25.

The lever 42 is interconnected by means of a rod 43 to any suitable manually operable device, of the knee or foot pedal type (not shown) and serves as a means for actuating the regulating device for the differential feed.

A helical return spring 44 (FIG. 2) is mounted on the auxiliary shaft 17, with one arm thereof bearing against lever 42 and the other arm 46 bearing against a projection 47 formed on the dividing wall 26. This spring serves to pivot the lever 42 downwardly so as to move the gear 35 upwardly against the flange 29 each time the operator actuates the manually operable device described above.

The actuating device is selectively rotatable within the bushing 27 by means of a control knob 48 that is inserted elastically in a central hole 49 provided in said actuating device 28. The knob 48 is provided with a depending tubular shaft 50 having a longitudinal cavity 51 within which a coil spring 52 is assembled in a manner whereby its lower end engages the transverse pin 39 carried by the actuating device 28.

In order that the actuating device 28 and the control knob 48 will rotate together, the shaft 50 is provided with two diametrically opposed and longitudinally extending slots 53 through which the above-mentioned transverse pin 39 extends. Additionally these slots provide a means whereby the knob 48 can be pushed downwardly to a position where it will not interfere with the upper and outer surface of the base 24 when not in use.

With reference to FIG. 3, the control 73 is supported by a plate 54 of which the bushing 27 forms an integral part and provides a means for mounting said control within the base 24 by means of screws 55.

The upper surface of the base 24 is formed by a closure cap 56 that is supported on a pin 57 which is slidably and rotatably mounted in a seat 58.

The closing of the cap 56 is effected by means of rotational and downward pressure applied thereto which causes the knob 48 to be forced downwardly by said cap so that the upper surface of the base 24 is provided with a continuous flat surface contiguous with the adjacent surface which is identified in FIG. 3 by numeral 59.

With the maximum extension of the range of regulation for the travel of the differential feed dog with respect to that of the main feed dog being determined by the length of a slot 60 located on the second sector 10, it is sufficient to impart to the lever 42 an initial angular movement that will determine the position of the slider 15 on said second sector 10. This position fixes the lower limit of the desired range of regulation, while the upper limit is fixed by the end of the remaining portion of the slot 60.

To effect selective angular movement of the lever 42 so as to position the slider 15 initially on its associated sector, the knob 48 is simply rotated in one of the two directions indicated by the arrows 61 (FIG. 3) and in this way a rotational movement is imparted to the gear 35 which by means of the endless screw 36 causes an angular movement of the toothed sector 41 with which it is in mesh.

The springs 40 and 44 are effective in preventing the gear 35 from moving downwardly so that contact with the underside of the flange 29 will be maintained and the desired rotation transmitted to the lever 42.

When the sewing machine is running, variation in the travel of the differential feed dog within the predetermined limits is obtained by actuating the manual drive to move the rod 43 in the direction of the arrow 62 (FIG. 2) so as to rotate the lever 42 upwardly and, initiate the upward movement of the slider 15. As a result of the rotation of the lever 42, the gear 35 moves downwardly in contrast with the combined action of the two springs 40 and 44.

In this case the endless screw 36 acts as a rack in that with the rotation of the toothed sector 41 there corresponds the motion of the gear 35. To avoid excessive stress between the teeth of the toothed sector 41 and of the gear 35, relative to the two extreme positions that can be attained by the slider 15, the lever 42 is provided with two stops 63 and 64 that are symmetrically arranged relative to the auxiliary shaft 17. During rotation of lever 42 these stops 63 and 64 are adapted to engage adjustable screws 65 and 66 which are located on the plate 54.

In particular, the adjustable screw 66 can be positioned in such a way as to bring the upper limit of the desired range of regulation closer to the lower limit.

A control 73 of the type heretofor described which requires a minimum amount of space in a sewing machine, can be used to advantage in those machines whose base has a special shape and very limited available space. An example of such sewing machines are those having an elbow-shaped base such as shown in FIG. 4, where most of the area of the base is taken up by the operator's arms and by the material that is wrapped around it during operation of the machine. If the control could not be located within the base as described above it could create serious problems relative to the handling of the material or could require locating said control remote from the area most practical for it to operate, that is, the area adjacent the stitching instrumentalities.

Therefore, a special feature of the control described herein, is that it is completely contained within the base of the sewing machine and at a location most desirable for its operative connection to the feed device and accessibility by an operator.

Although the present invention has been described in connection with a preferred embodiment, it is to be understood that modifications and variations may be resorted to without departing from the spirit and scope of the invention as those skilled in the art will readily understand.

Such modifications and variations are considered to be within the purview and scope of the invention and the appended claims.

I claim:

1. A control for the differential feed regulating device within the base of a feed-off-the-arm sewing machine of the type having an oscillatably driven feed shaft for reciprocating the support arms on which the main feed dog and the differential feed dog are mounted, said control comprising:

a. an auxiliary shaft (17) mounted for selective rotational positioning within the base;

b. a regulating means (14) interconnecting said auxiliary shaft (17) with the support arm for the differential feed dog;

c. means (73) within the base and operatively connected to said auxiliary shaft (17) for adjusting the extent of movement of said regulating means (14) so as to selectively vary the distance of travel of the differential feed dog relative to that of the main feed dog including:

i. an actuating device (28) defining a flanged sleeve rotatably mounted within the base;

ii. a gear member (35) assembled on the outer periphery of said actuating device;

iii. rotating means operatively connected to said actuating device (28) and gear member (35) for effecting selective simultaneous movement thereof;

iv. a tooth sector (41) fixed on said auxiliary shaft (17) in meshing relation with said gear member (35) for selectively adjusting said regulating means by said rotating means; and d. means (42, 43) fixed on said auxiliary shaft (17) in operative association with said adjusting means for selectively moving said regulating means (14) to effect movement of the differential feed dog within the limits determined by said adjusting means.

2. The control according to claim 1 wherein said moving means includes:

a. a lever (42) fixed on and extending from said auxiliary shaft (17) having a rod (43) pivotally connected to one end thereof for effecting manual movement of said auxiliary shaft;

(b) spaced stop members (63, 64) mounted on said lever (42) defining the maximum and minimum obtainable positions of said auxiliary shaft (17) by said regulating means (14); and (c) a return spring operatively connected to said lever (42) for moving the latter to its initial position after actuation by said rod (43).

3. The control according to claim 1 wherein said rotating means includes:

a. a control knob (48) having a depending tubular shaft (50) slidably assembled in said actuating device (28); and b. a transverse pin (39) fixed in said shaft (50) with the ends thereof extending into operative association with said actuating device (38) and gear member (35) to effect simultaneous rotative movement thereof by said control knob (48).

* * * * *